United States Patent [19]

Pacitti et al.

[11] 4,367,895

[45] Jan. 11, 1983

[54] RECLINABLE CHAIR

[75] Inventors: William Pacitti, Monroe; Harold P. Ruble, Deerfield, both of Mich.

[73] Assignee: La-Z-Boy Chair Company, Monroe, Mich.

[21] Appl. No.: 154,374

[22] Filed: May 29, 1980

[51] Int. Cl.[3] ..... A47C 1/02; A61G 15/00

[52] U.S. Cl. ..... 297/85; 297/83; 297/84

[58] Field of Search ..... 297/83–86, 297/342

[56] References Cited

U.S. PATENT DOCUMENTS

| | | | |
|---|---|---|---|
| 3,096,121 | 7/1963 | Knabusch et al. | 297/269 |
| 3,099,487 | 7/1963 | Knabusch et al. | 297/69 |
| 3,743,349 | 7/1973 | Crumetal | 297/85 |
| 3,758,151 | 9/1973 | Re | 297/83 |
| 4,071,275 | 1/1975 | Rogers | 297/85 |
| 4,077,663 | 3/1978 | Cycowicz et al. | 297/83 |
| 4,108,491 | 8/1978 | Rogers | 297/85 |
| 4,226,468 | 10/1980 | Johnson | 297/83 |
| 4,244,620 | 1/1981 | Harrison et al. | 297/85 |

*Primary Examiner*—Ronald Feldbaum

*Attorney, Agent, or Firm*—Harness, Dickey & Pierce

[57] ABSTRACT

A chair has a chair body pivoted on a carriage and a reclining back on the chair body operates linkage to move the carriage on a base and to tilt the chair body with respect to the carriage. A hand lever operates a leg rest mounted on the chair body and, at the same time, operates through linkage to tilt the chair body on the carriage.

31 Claims, 11 Drawing Figures

FIG. 1.
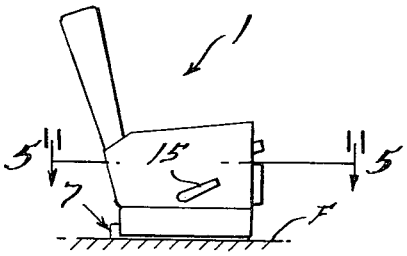
FIG. 2.
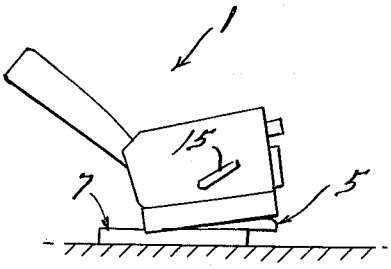
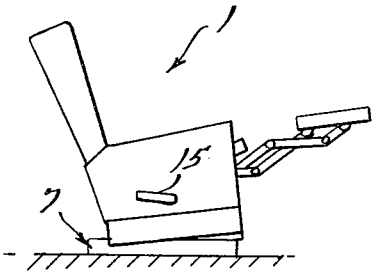
FIG. 3.
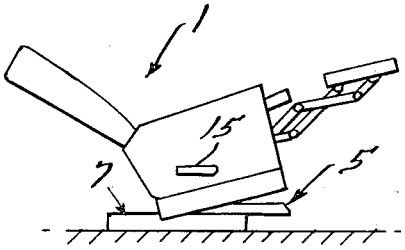
FIG. 4.
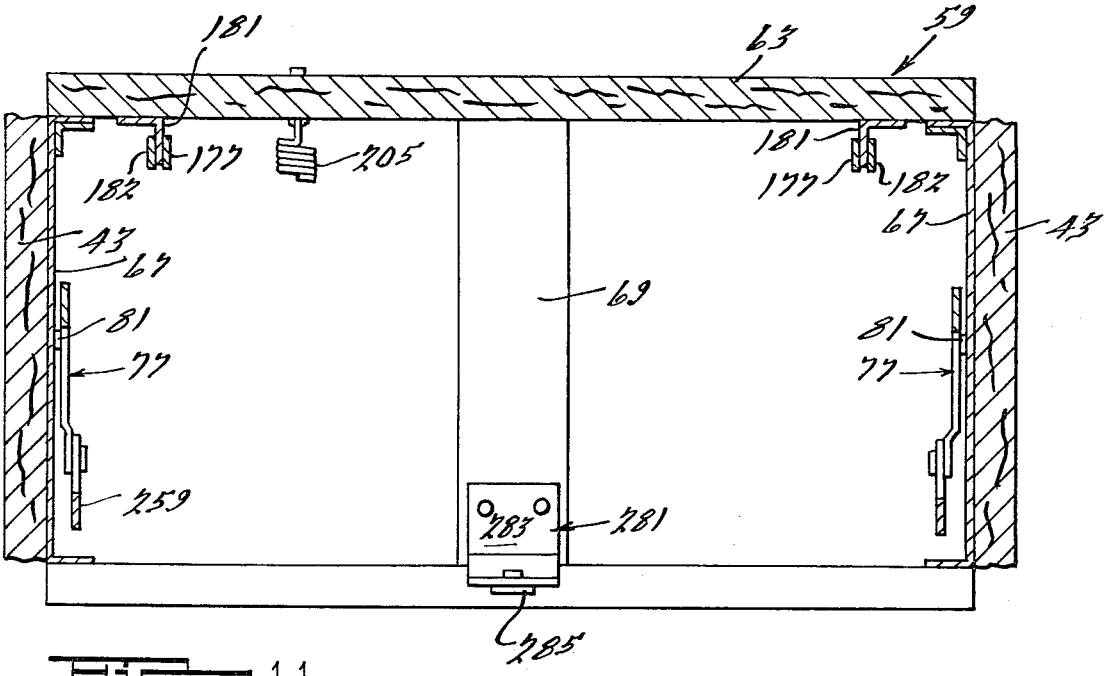
FIG. 11.

RECLINABLE CHAIR

BRIEF SUMMARY OF THE INVENTION

This invention relates to chairs with reclining backs and/or movable leg rests. Upholstered chairs embodying the invention are especially suitable as furnishings for the home.

It is a purpose of the invention to provide a chair which is automatically tilted in response to movement of the back and/or movement of the leg rest.

It is also a purpose of the invention to provide a chair in which a chair frame is mounted on a carriage and movement of the back relative to the chair frame automatically moves the carriage fore or aft on a fixed base.

In a preferred embodiment of the invention, a back frame and a seat frame are movably mounted on a chair frame and interconnected by linkage so that reclining movement of the back in response to applied pressure from the back of a person sitting in the chair automatically moves the seat upwardly and forwardly. The chair frame is pivotally mounted on a carriage which moves back and forth on a base and the back recline linkage actuates a push link mechanism that activates this carriage movement. A friction means to custom adjust the force required to recline is preferably used with the back recline linkage.

The chair of this preferred embodiment has an adjustable leg rest which is operated independently of the reclinable back by means of a hand lever which turns a drive shaft that activates leg rest linkage. A spring assist toggle mechanism is preferably used to assist in elevation of the leg rest and to yieldably hold it in retracted position. Also, a detent mechanism is preferably used to yieldably hold the leg rest in several different positions. The drive shaft for the leg rest also operates a tilt link mechanism which is connected to an extension of linkage that supports the front of the seat frame on the chair frame. Operation of the drive shaft operates the tilt mechanism to tilt the chair frame on the carriage whenever the leg rest is moved. Tilting due to back recline and tilting due to leg rest movement are automatic and independent of each other and are cumulative. Thus, in the preferred embodiment full recline produces tilt of about 7°; full leg rest elevation produces tilt of about 6°; full recline and full leg rest elevation together produce tilt of about 13°.

Forward movement of the chair frame during recline of the back compensates for the rearward movement of the back and maintains a substantially constant clearance between the chair and an adjacent table, wall, etc. that may be located behind the chair. In a chair according to the present invention, the forward or backward movement is easily initiated by the chair occupant by simple leaning of his or her body backwardly or forwardly to apply or remove back pressure from the chair. It is not necessary to apply leverage with the arms or feet to get started or to control or assist the movement. Automatic tilting of the chair of this invention in conjunction with relative movement of the chair back contributes significantly to this ease and smoothness of operation and also provides an added increment of comfort in use of the chair. Automatic tilting of the chair of this invention in conjunction with operation of the leg rest also provides a significant increase in comfort during use of the chair.

The invention has other advantageous features which will become apparent hereinafter.

DESCRIPTION OF THE DRAWINGS

FIG. 1 is a schematic side elevation of a chair embodying the invention shown in the upright position;

FIG. 2 is a side elevation of the chair of FIG. 1 shown in the full recline position and with the chair body automatically moved forwardly on the base;

FIG. 3 is a side elevation similar to FIG. 1 but showing the leg rest in the fully extended position and the chair automatically tilted back;

FIG. 4 is a side elevation similar to FIG. 2 but with the leg rest in the fully extended position and the chair automatically tilted back;

FIG. 11 is a vertical cross section across the front of the chair, with parts broken away and removed for clarity, to show the front cross brace structure for the chair frame.

DESCRIPTION OF THE INVENTION

Figure 6:
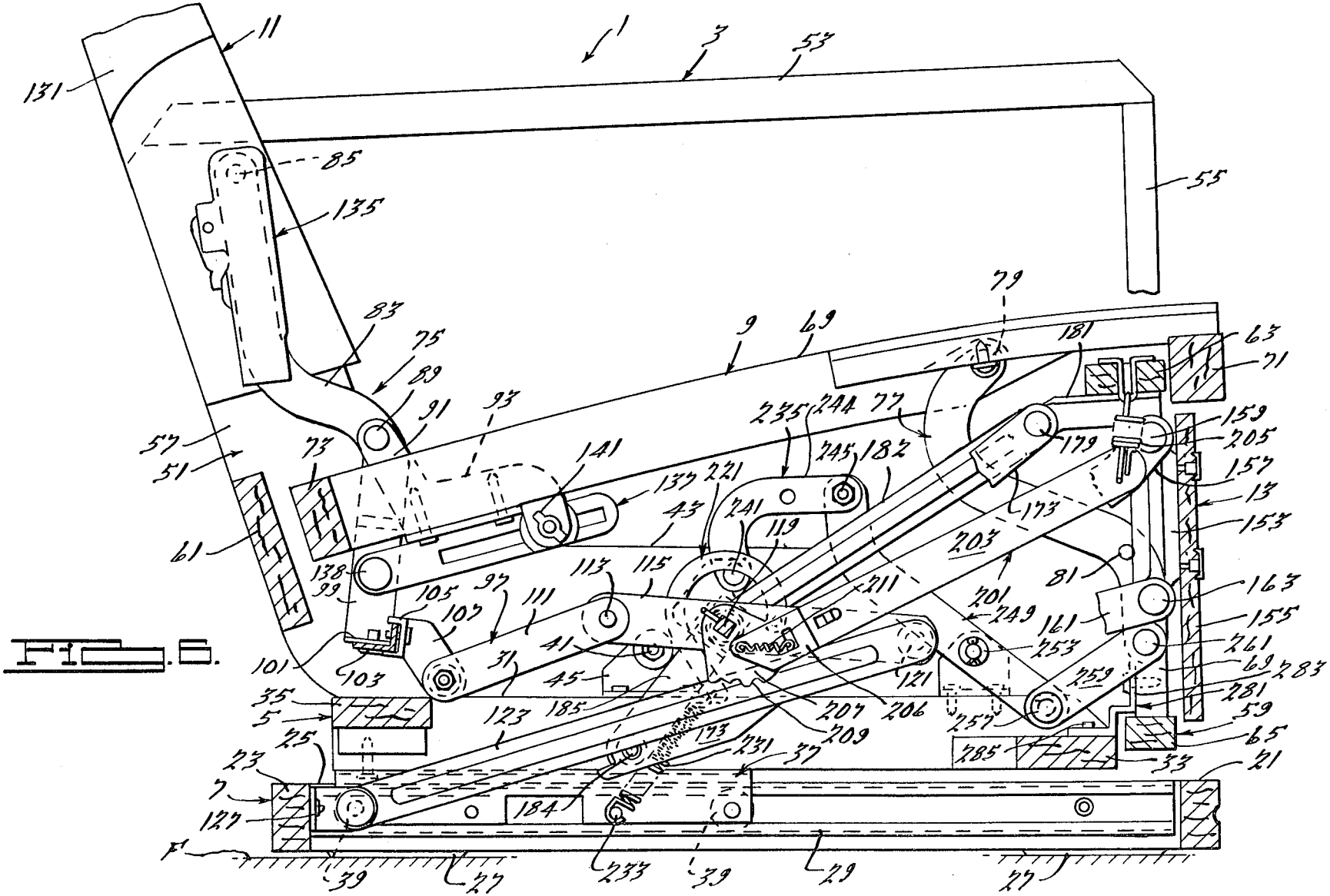
FIG. 6 is a vertical cross section along line 6—6 of FIG. 5 with parts broken away, showing the various linkage mechanisms in the left half of the chair, the right half being the same except that there is no adjustable leg rest support mechanism in the right half and the parts are on the right hand instead of the left hand as shown.

In overall structure as most readily seen in FIG. 6, the chair 1 comprises a chair frame 3 which is movably supported on a carriage 5. The carriage 5, in turn, is movably supported on a base 7 which rests on the floor F. A seat frame 9 and a back frame 11 are movably supported on the chair frame 3. A leg rest frame 13 is also movably supported on the chair frame. The chair frame 3, seat frame 9, back frame 11, and leg rest frame 13 are each constructed in a manner (e.g. of wood) that enables them to support springs, padding, upholstery, etc., in order to complete a decorative, stylish, comfortable chair for use in the home.

In overall operation as shown in FIGS. 1–4, the chair 1 has an upright position (FIG. 1) in which an occupant may enjoy conventional seating. However, if the occupant lays back in the chair to apply deliberate pressure against the chair back, the chair back will tilt backwardly on the chair body. As this takes place, linkage mechanism causes the seat to move a little forwardly and upwardly to retain seating comfort while the included angle increases between the seat and back as the chair moves to an extended, expanded position approaching that of a bed, i.e., the full reclining position (FIG. 2). While this relative movement of chair, back, and seat frames takes place, the linkage mechanism also causes the carriage 5 and chair frame 3 to move forwardly on the base 7 so that the top of the chair back remains in substantially the same vertical plane. It also causes some backward tilting of the chair body on the carriage 5. All this is reversed, and the chair returned to an upright position, by deliberate application of rearward pressure to the seat frame or, more simply, if the occupant leans forward to remove pressure on the chair back in which event the chair smoothly moves back to the upright position of FIGS. 1 or 3. The leg rest is independently operated by means of a handle-lever 15 on the right side of the chair. However, in accordance with a special feature of this invention, operation of the leg rest also tilts the chair body backwardly a few degrees.

In the upright position of a preferred embodiment of the chair 1, and with the leg rest in the down (inoperative) position (FIG. 1), the bottom of the chair body is parallel to the floor (or horizontal), the seat is on an angle of about 13° to the horizontal, and the back makes an angle of about 70° to the horizontal. When this chair is in the full recline position (FIG. 2), the bottom of the chair is tilted up to an angle of about 7° to the horizontal, the seat is still on an angle of about 13°, but somewhat higher, and the back makes an angle of about 35° to the horizontal.

In the upright position of the preferred embodiment with the leg rest in fully extended, horizontal, (operative) position (FIG. 3), the bottom of the chair makes an angle of about 6° with the horizontal, the seat an angle of about 19° to the horizontal, and the back an angle of about 64° to the horizontal. In the full recline position of the chair with the leg rest fully extended (FIG. 4), the bottom of the chair body is on an angle of about 13° to the horizontal, the seat on an angle of about 19° but somewhat higher, and the back on an angle of about 29°. Raising the leg rest to the fully extended position tilts the chair along with the seat and back which are mounted on it, backwardly about 6°. Raising the leg rest to only intermediate positions, tilts the chair proportionately less.

The chair structure for providing the above relationships is all mounted on and supported by the base 7 which is in the form of a rigid rectangular frame defined by front and rear cross bars 21 and 23 (FIG. 6) secured to opposite ends of left and right hand side bars 25 (only the left hand of this and other parts being shown in order to simplify the drawings). The bottom faces of the side bars 25 may carry wide, thin plastic, glide pads 27 that actually engage the floor F. Metal channel-shaped tracks 29 are rigidly secured to side bars 25 to form their vertical inside faces. The tracks 29 are parallel to the floor F and provide means to movably support the carriage 5 so that it can be moved back and forth, parallel to the floor, between the front and rear cross bars 21 and 23.

The carriage 5 is also in the form of a rigid rectangular frame defined by left and right hand side bars 31 (FIGS. 5 and 6) secured to front and rear cross pieces 33 and 35 (FIG. 6). The side bars 31 overlie base side bars 25 but are somewhat shorter in length. Angle shaped metal brackets 37 have horizontal flanges that are rigidly secured to the bottoms of the back halves of the side bars 25 and downward vertical flanges which rotatably carry and support front and rear bearing wheels 39 that are located within the tracks 29. The length of the brackets 37 is approximately one-half the length of the tracks 29 therefore providing for carriage movement forward of about one-half the track (base) length upon full recline of the chair. The carriage 5 carries the chair frame 3 and transfers load from it into the base 7 through the wheels 39.

The chair frame 3 carries most of the load on the chair 1 and transfers it into the carriage 5 through left and right hand but coaxial pivot pins 41 secured to left and right hand side bottom members 43 of the chair frame 3. The pivot pins 41 are supported on vertical flanges of angle-shaped pivot brackets 45 that are mounted on the tops of the left and right hand side bars 31. The pivot pins 41 are shown as located between the front and rear wheels 39 and somewhat closer to the front wheel than to the rear wheel, i.e., above the front halves of the brackets 37. They are located sufficiently far forwardly so that most of the weight of a chair occupant is concentrated between them, i.e., between the pins 41 and the chair back frame 11. The chair frame 3 tilts relative to the carriage, base, and floor on pivot pins 41 under control of linkage mechanism to be described. The pivot means fixes the longitudinal position of the chair frame 3 on carriage 5 so that the two move back and forth together with respect to the base 7.

Figure 7:
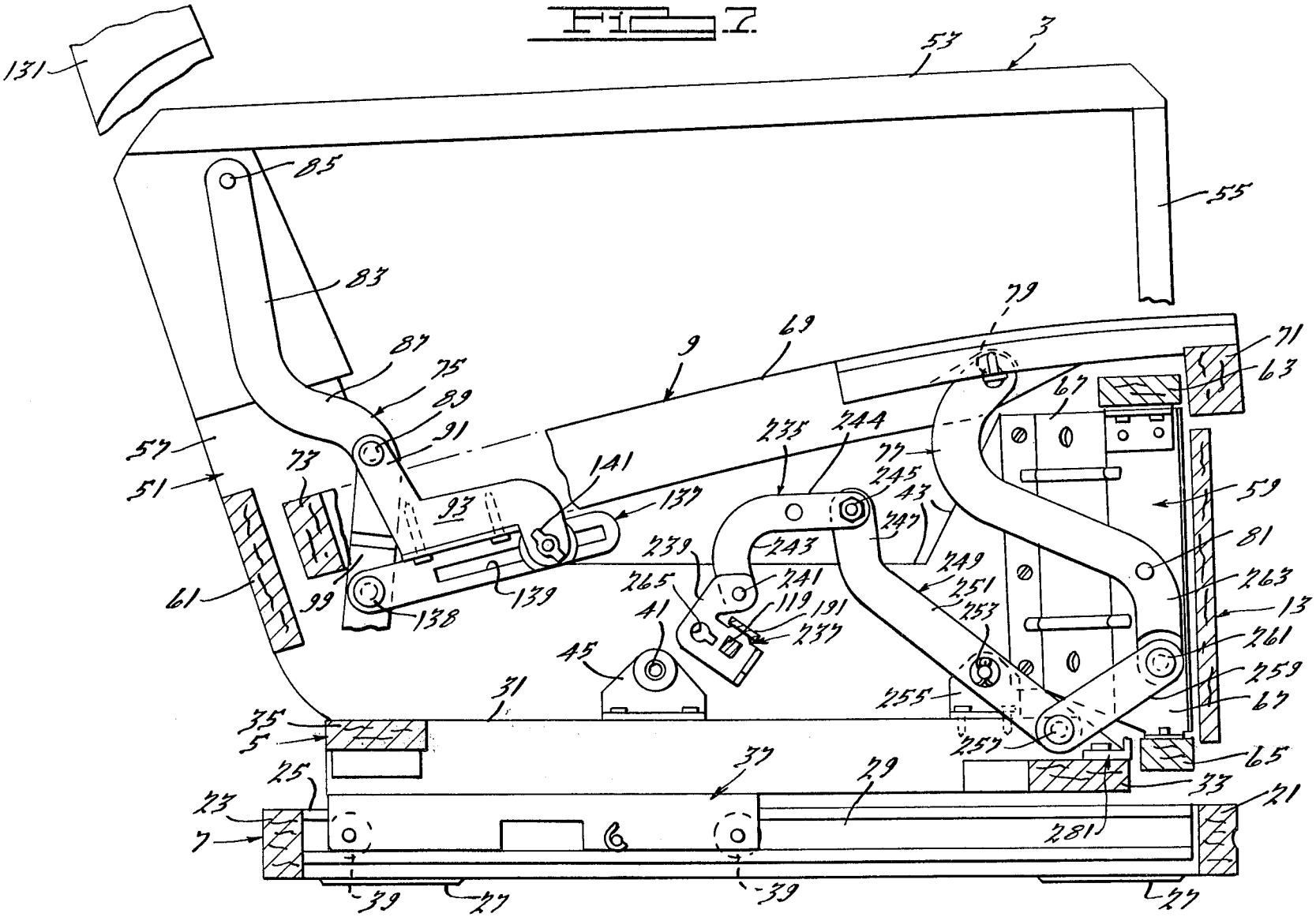
FIG. 7 is a vertical cross section along the line 7—7 of FIG. 5 with parts removed and broken away and shows in particular the front cross brace structure for the chair frame and the front seat swing support and tilt linkage for the seat frame, various other parts being omitted for clarity.

Referring to FIG. 7, the chair frame 3 has opposite sides 51 in the form of rigid, roughly rectangular frames defined by the previously mentioned horizontal bottom members 43 and by top horizontal members 53 which function as the chair arms. Each side frame 51 further includes a front post 55 which preferably has at least a lower portion substantially perpendicular to the floor F. Further, each side frame has an inclined rear post 57. The posts 55 and 57 are rigidly secured to the top and bottom members 53 and 43. The left and right hand side frames 51 are rigidly interconnected to form the chair frame 3 by a front cross brace structure 59 (FIG. 11) and a rear cross piece 61. The front cross brace structure 59 comprises horizontal upper and lower cross pieces 63 and 65 which in the embodiment illustrated are united at their left and right hand ends by rigid, steel, vertical plates 67, the rear vertical edges of which are rigidly secured to the bottom members 43 of the chair frame 3. A central wood post 69 is also shown as uniting the top and bottom members 63 and 65.

The seat frame 9 is supported on the chair frame 3 and is located between the side frames 51 at a suitable distance below the arms 53. The seat frame is a rigid rectangular structure that has some curvature in a vertical plane whereby its top surface is convex as seen in the drawings. The seat frame 9 has left and right hand side bars 69 which are rigidly secured to opposite ends of front and rear cross pieces 71 and 73, respectively.

The seat frame 9 is supported on the chair frame 3 by a metal parallelogram type linkage mechanism 75 so that as it moves horizontally it also moves up or down, depending upon whether it moves to the front (during recline) or to the rear (on return to upright). The linkage mechanism 75 includes left and right hand curved, front, swing links 77. Each is pivoted at its top end to the seat side bar 69 at about the three-quarters point in the bar length as indicated at 79 whereby load on the seat passes into the link. Each link 77 is concave forwardly, rather J-shaped, and at the tip of the J is pivoted at 81 to the adjacent steel plate 67. Thus, load on the seat frame 9 passes in compression through the link 77, into the pivot 81, and then into the plate 67 which is a part of chair frame 3.

The seat support linkage mechanism 75 also includes left and right hand rear swing links 83 which extend vertically well above the level of the seat frame 9 along side the rear posts 57 of the chair frame sides 51 to which they are pivoted just below the arms 53 at 85. The long straight top portion of each link 83 is almost perpendicular to the floor but slants a little toward the front of the chair. A forwardly offset intermediate section 87 of each link 83 is pivoted at 89 to an upstanding post section 91 of an angle shaped bracket 93 that has a horizontal flange securely fixed to the bottom of seat side bar 69 very close to the back end of the seat frame. Load on the rear of the seat frame 9 passes into the bracket 93 and through pivot 89 into the rear swing link 83 (as tension in the link) which transfers it by way of pivot 85 into the chair frame 3. Thus, the rear of the seat frame 9 moves in the manner of a controlled pendulum on and below upper pivots 85 while the front of the frame can swing to and fro above and on front pivots 81.

Figure 8:
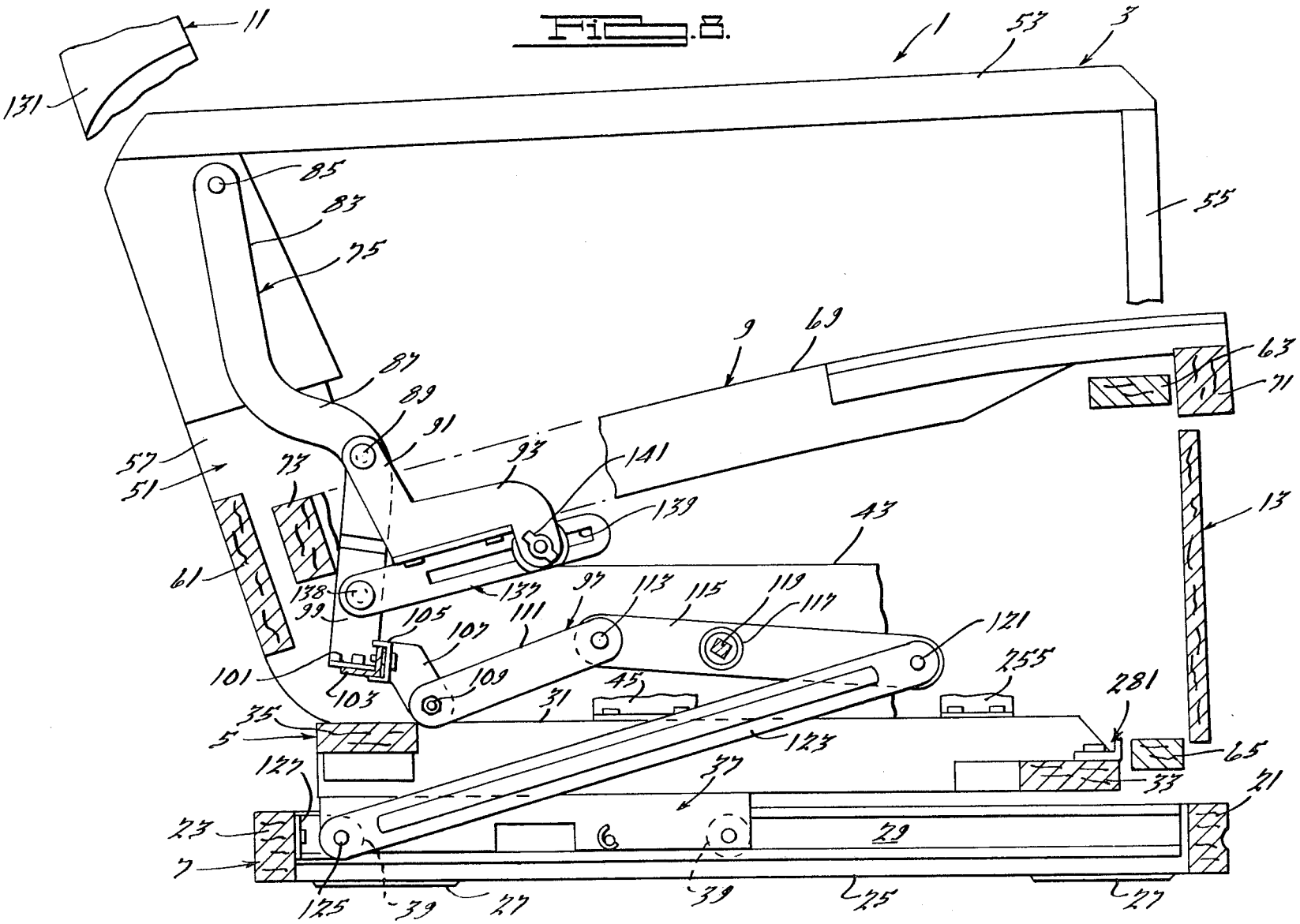
FIG. 8 is a vertical cross section along the line 8—8 of FIG. 5 with parts removed and broken away and shows in particular the rear seat swing support linkage and the push link mechanism that is connected to and operates with tilting of the linkage, various other parts being omitted for clarity.

Push link or translation mechanism 97 is provided that translates movement of rear swing links 83 into fore and aft movement of the carriage 5 (and chair frame 3) on base 7. As seen best in FIG. 8, the swing links 83 have straight sections 99 extending downwardly from offset intermediate sections 87 and the bottom end of each is turned inwardly at a right angle to form a flange 101 that is fixed to a horizontal, transverse, angle shaped, straight, draw bar 103. The bottom ends of the left and right hand swing links 83 carry the draw bar 103 so that it swings to the front when the link 83 shown in FIG. 8 pivots counterclockwise about pivot 85 and back to the rear when the pivoting is clockwise. This motion of the draw bar 103 carries left and right hand brackets 105 that are fixed to it and have rigid downwardly extending legs 107. The leg 107 of each bracket is pivoted at 109 to the rear of a straight, upwardly slanted floating link 111 which is pivoted at its forward end 113 to the rear of a downwardly slanted link 115 that rocks on a pivot bushing and spacer sleeve 117 through which passes a square cross shaft 119 operated by handle 15 (FIG. 5) and suitably supported at opposite ends in bearing means 120 in the chair frame members 43. Thus, the shaft 119 fixes the longitudinal position of link 115 on the chair frame 3 but is independent with respect to angular movement. The front end of each link 115 is pivoted at 121 to the front end of a straight link 123 which has its rear end pivoted at 125 to a bracket 127 that is fixed to the rear cross piece 23 of the rigid base 7. Dimensions are selected so that when link 115 is vertical, link 123 is substantially horizontal. When the draw bar 103 goes forward the pivot 121 tries to go backward but is prevented to a substantial extent by push link 123. Thus, the link 115 is translated forwardly, carrying with it the cross shaft 119 which carries with it the chair frame 3, which carries with it the carriage 5, the latter rolling on its wheels or bearings 34 in the tracks 29 on the side bars 25 of the base 7. When the draw bar 103 moves to the rear, the operation is reversed and the carriage and chair frame also move to the rear. Fore and aft movement also produces slight tilting (up to about 7°) of the chair frame 3 as will be described.

The primary means of moving the link 83 is the back frame 11. Backward pressure against the back frame above the level of pivots 85, as when a chair occupant lays back in the chair, will force the back frame to pivot backwardly (FIGS. 2 and 4) on the chair frame 3 and the links 83 to swing forwardly or counterclockwise, thereby rolling the carriage 5 and the chair body 3 forwardly.

Figure 5:
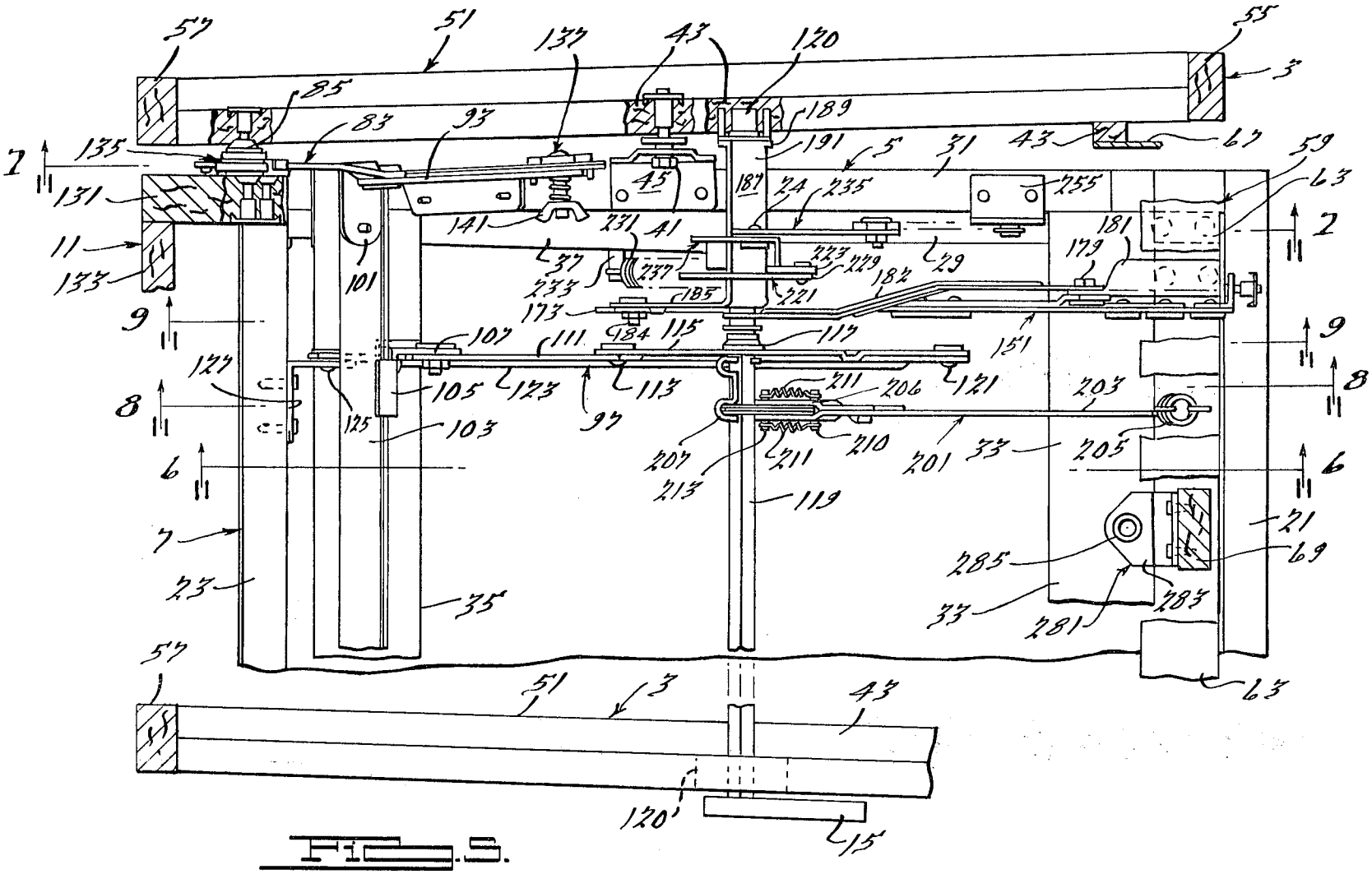
FIG. 5 is a horizontal cross section along line 5—5 of FIG. 1 with upholstery and springs and seat frame removed and parts broken away. Only the linkage on the left half of the chair is shown (for clarity); the right half is identical, but on the right hand, except as noted hereinafter.

The back frame 11 is in the form of a rigid, rectangular frame that includes left and right hand side members 131 and appropriate cross pieces, such as the lower cross piece 133 (FIG. 5). It is removably mounted on the upper parts of links 83 by means of slide brackets 135 secured at suitable locations on the side members 131. A preferred form of bracket 135 for this type of mounting is shown and described in U.S. Pat. No. 3,525,549, issued on Aug. 25, 1970. Each bracket 135 is channel shaped in cross section to provide an interior track that slidably receives the link 83 and readily slips on and off the link. When the brackets 135 are mounted on the links 83 the back frame is, in effect, an extension of the links 83 above the pivots 85. The back frame 11 can be tilted on pivots 85 and acts as a lever means to angularly move the links 83 about the pivots 85. The force required for this tilting, and thus fore and aft movement of the chair frame 3, is preferably selectively adjustable through the use on each side of the seat of a controllable resistance means in the form of a multiple layer slide friction link means 137. Link means 137 has one end pivoted as 138 to the portion 99 of each swing link 83 and has a slot 139 through its plural layers which receives a hand-adjusted, spring pressed wing nut-screw-and washer means 141 mounted on a downwardly extending, forward arm 143 of seat bracket 93. The frictional resistance of the link means 137 to sliding in slot 139 and thus to relative movement of link 83 and bracket 93 can be adjusted by turning the wing nut to suit the user of the chair 1.

Figures 9, 10:
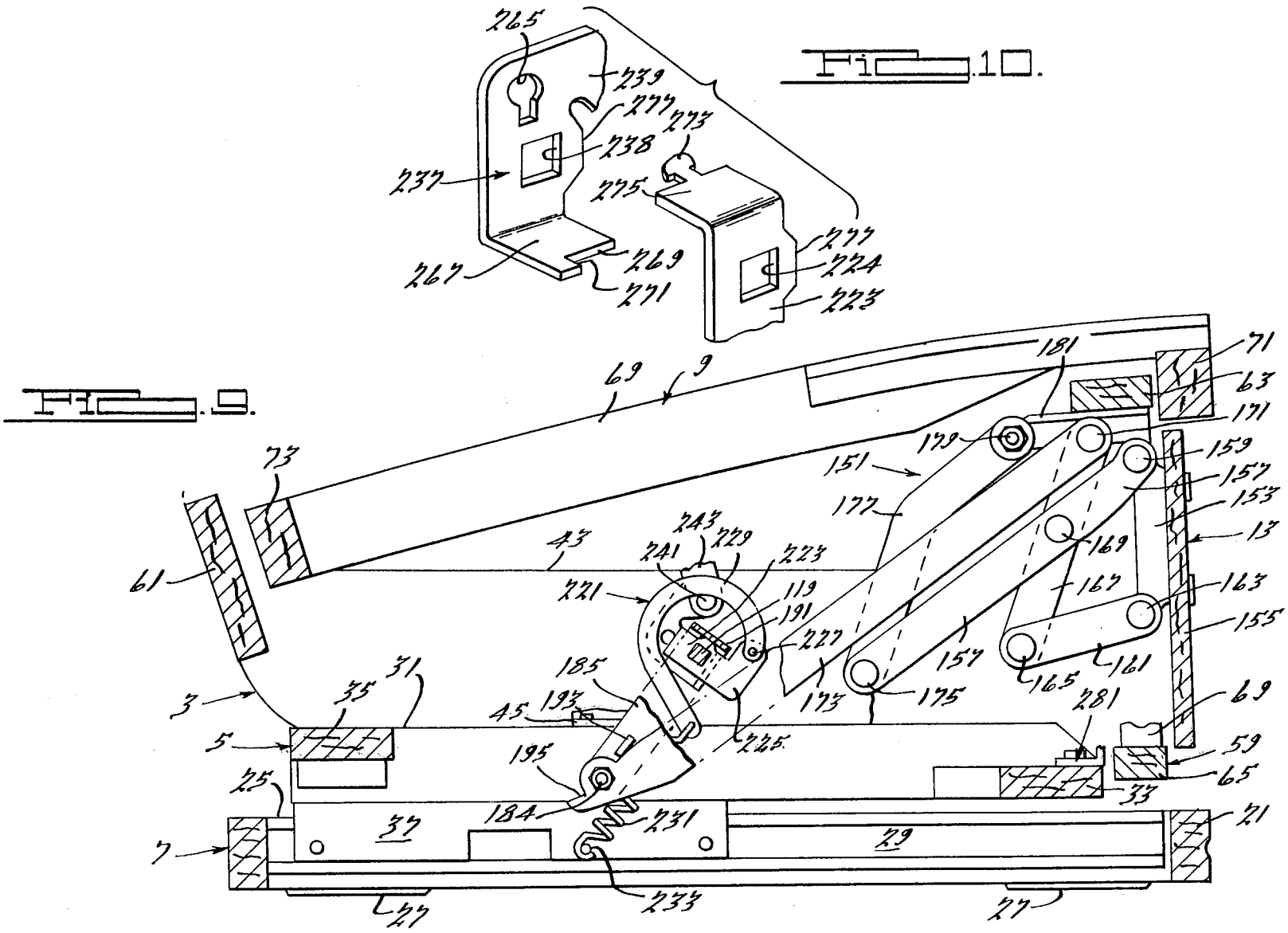
FIG. 9 is a vertical cross section along the line 9—9 of FIG. 5 with parts removed and broken away and shows in particular the leg rest operating mechanism and the leg rest spring assisted toggle mechanism, various other parts being omitted for clarity.
FIG. 10 is a perspective exploded view of interconnected toggle and tilt levers that are mounted on the drive shaft and shown in operating condition in FIGS. 9 and 7, respectively.

As seen best in FIG. 9, the leg rest frame 13 is preferably supported on and moved by left and right hand extensible metal pantograph type linkages 151. The left hand linkage 151 shown is pivoted to an angle shaped metal bracket 153 that is fixed on the inside of a flat panel 155 which forms the leg rest frame 13. Pantograph link 157 is pivoted at 159 to an upper part of the bracket 153 and link 161 is pivoted at 163 to a lower part of the bracket. Link 161 is pivoted at 165 to the bottom of link 167 and link 157 is pivoted at an intermediate point to an intermediate point of link 167 as seen at 169. The top of link 167 is pivoted at 171 to the top of long support link 173 while the bottom of link 157 is pivoted at 175 to the bottom of a slightly curved support link 177, the top of which is pivoted at 179 to an angle shaped metal bracket 181 that is fixed to the bottom of cross piece 63 which is a part of the chair frame 3. A ribbed offset spacer link 183 (FIGS. 5 and 6) is also pivoted at 179 to bracket 181 and journaled at its lower end for relative angular movement on cross shaft 119 by way of spacer bushing 183 on the shaft. It serves to stabilize and locate the shaft 119 and linkage mechanism 151.

The bottom of long support link 173 is pivoted at 184 to the bottom of the long leg 185 of a U-shaped drive and spacer bracket 187. The bracket 187 has a short leg 189, parallel to leg 185, and joined to it by the base 191 of the U. Both legs 185 and 189 have aligned holes in them through which the square drive shaft 119 extends, whereby the base 191 is parallel to the shaft. Long leg 185 has a square hole for shaft 119 to provide means whereby turning of the shaft 119 about its longitudinal axis by handle lever 15 also turns the drive bracket 187 to swing the legs 185 and 189. Counterclockwise rotation of the long leg 185, so that it moves toward the front in FIG. 9, drives long link 173 and actuates the pantograph 151 in conjunction with fixed pivot 179 so that the panel 155 goes from the vertical position of FIG. 9 to the extended horizontal position of FIG. 2 or 4. At this position the stop tab 193 on long leg 185 is in contact with stop shoulder 195 on the end of long link 173 and the leg 185 and link 173 are almost in longitudinal alignment but cannot go over center because of engagement of the stop and stop shoulder. Thus, the leg rest frame 13 is held in horizontal position with leg weight taken by the shaft 119 and pivot 179.

As seen in FIGS. 5 and 6, one metal adjustable leg rest support mechanism 201 is used in the chair 1 to provide means for supporting the leg rest frame 13 in two positions between the vertical and horizontal positions shown in FIGS. 1–4. The mechanism 201 may be substantially the same as structure shown in U.S. Pat. No. 3,325,210, issued June 13, 1967. It includes the inclined link 203 which is suspended at its front end from the cross piece 63 of chair frame 3 by a tension spring hanger assembly 205. The other end of the link 203 is bifurcated at 206 to receive the edge of a sector-shaped plate member 207 that is mounted by way of a square hole on shaft 119 to rotate with it. The plate 207 has specially shaped recesses 209 in its outer periphery to act as ratchet means cooperating with a floating transverse ratchet or detent pin 210 carried by the bifurcations 204 and urged into the recesses 209 by tension springs 211 anchored on a pivot pin 213 between the plate 207 and link 203. When the shaft 119 is turned to operate the leg rest frame 13 through linkage 151, the plate 207 is also turned to expose different recesses 209 to the pin 210 depending upon the angle of turn and elevation. When the pin is in a recess, the leg rest is yieldably held in position against inadvertent angular movement by the mechanism 201. The spring 205 accommodates relative movement between the link 203 and cross piece 63 due to movement of pin 213 with plate 207.

Referring to FIG. 9, a metal toggle link mechanism 221 is mounted on shaft 119 and provides means to hold the leg rest panel 155 in fully retracted position against the front of the chair frame and means to supply a spring assist to extension of the leg rest frame 13. The mechanism comprises a lever 223 with a square hole receiving shaft 119 whereby the lever turns with the shaft. The lever 223 is mounted between the two legs of spacer 187 and projects beyond them where it has a right angle leg 225 extending parallel to legs 185 and 189 of the spacer 187. The upper end of leg 225 is pivoted at 227 to the front end of C-shaped toggle link 229 that curves around the outside of spacer 187 and across leg 185 where it has an opening in which is hooked the end of a helical coil tension spring 231. The spring axis is substantially parallel to leg 185 and the bottom end of the spring is anchored on a pin 233 fixed to the bracket 37 on carriage 5. Thus, in the leg rest retract position of FIG. 9, the spring pull on C-link 229 holds the panel 155 in place. When shaft 119 is rotated counterclockwise to elevate the leg rest, the pivot 227 will evantually move up and go over center, whereupon the spring 231 will assist operation of handle 15 and turning of shaft 119.

Turning of shaft 119 to move the leg rest frame 13 will tilt the chair frame 3 through operation of tilt linkage mechanism 235 (FIG. 7) which is preferably an extension of front swing link 77. Preferably, to facilitate assembly and operation, the toggle lever 223 is connected to mechanism 235 as will be described. The mechanism also produces tilting of the chair frame 3 when the back frame 11 (swing links 83) is moved.

The tilt linkage 235 includes a lever 237 that has a square hole which receives shaft 119 whereby it turns with the shaft. The lever 237 is located inside the spacer 187 and extends rearwardly and upwardly beyond the spacer base 191 where it has a right angle leg 239 extending parallel to the spacer legs 185 and 189. The upper end of leg 239 is pivoted at 241 to the bottom of a dog leg or substantially J-shaped link 243. Pivot 241 is a little forward of shaft 119 and the top portion 244 of link 243 is substantially horizontal in the leg rest retract position. The front end of the link 243 is pivoted at 245 to the substantially vertical top portion 247 of a long rocker link 249 that has a straight portion 251 slanting down toward the carriage front cross piece 33. The straight portion 251 is pivoted at an intermediate point 253 to an angle shaped pivot bracket 255 that is fixed on top of the carriage frame side bar 31 close to the front end of the carriage 5. The bottom end of the rocker link 249 is pivoted at 257 to the bottom of a short, tilt drive link 259. The top end of link 259 is pivoted at 261 to a substantially straight, vertical downward extension 263, beyond pivot 81, of the front seat support swing link 77. Pivot 261 is a little forward of pivot 81. The tilt linkage 235 provides significant force amplification, particularly through rocker link 249, so that the force required on handle 15 is not excessive even though some body weight is being lifted. Drive link 259 facilitates dual operation (by recline and by leg rest) of the tilt mechanism without problems of lock-up or bending and allows movement or position holding as intended.

As just indicated, the toggle lever 223 is connected to tilt mechanism 235 and, in particular, to driver lever 237. The interconnection properly spaces the two levers, increases their strength, holds alignment and prevents tip-over on the shaft 119, and facilitates manufacture, assembly, and operation of the toggle and tilt mechanisms. Referring to FIG. 10 (as well as FIGS. 7, 9 and 5), the tilt drive lever 237 has a key hole shaped opening 265 adjacent its leg 239 and a right angle flange 267 at its bottom which notched at the end to provide abutment surface 269 parallel to arm 239 and shoulder 271 perpendicular to it. At assembly, a latch projection 273 formed at the end of a right angle flange 275 at the top of toggle lever 223 is inserted through the hole 265 and moved down so that the thin neck of the latch 273 fits in the bottom, narrow slot of the keyhole 265 to hold the two levers against separation. In this position the lever 223 fits against the surface 269 and its vertical edge against the shoulder 271. When the shaft 119 extends through aligned holes 224 and 238, the levers are locked together in boxlike drive assembly that is sturdy, durable, and maintains proper position. The feature also reduces the need for close dimensioning of the parts. Each lever has a flat side surface 277 that is next to the inside surface of spacer base 191.

When square shaft 119 is rotated counterclockwise to lift the leg rest 13, pivots 241 and 245 will swing to the left, with pivot 241 going over center with respect to shaft 119. This motion rocks link 249 so that the part of it beyond pivot 253 goes up carrying the pivot 257 up. This imparts a vertical component of force to short drive link 259 which is transferred by pivot 261 into the bottom end 263 of front swing link 77. This upward force, therefore, reaches pivot pin 81 which is carried by the chair frame 3 and lifts the pivot pin 81 to tilt the chair frame 3 about its pivot 41 without affecting the position of the seat frame 9 relative to the chair frame. The tilt angle is proportional to the amount of elevation of the leg rest and, in the chair shown, is about 6° maximum as previously mentioned. This adds comfort when the leg rest is lifted. When the leg rest is lowered, the action is reversed. It takes place regardless of the recline position of the back frame 11. The weight shifting of the occupant during recline to the rear of pivots 41 help reduce resistance to operation of the leg rest mechanism.

When the rear swing link 83 is moved in a counterclockwise direction about pivot 85, as when recline is occurring, the seat frame 9 swings upwardly and forwardly. This is accommodated by clockwise rotation of front swing link 77 on pivot 81 which maintains the seat substantially parallel to its original position. The pivot 261 at the bottom of the lower end 263 of link 77 swings clockwise about chair frame pivot 81 toward the fixed carriage pivot 253. However, rocker link 249 resists movement and this is translated back through drive link 259 into an upward force on chair frame pivot 81 which tilts the chair frame 3 about its pivots 41. As previously mentioned, this tilt is about 7° for full recline of the back frame 11 in the present embodiment and corresponds to the position of the back frame 11. It occurs in any position of the leg rest 13.

The various linkage mechanisms (i.e., seat support 75, translation 97, swing resistance 137, leg rest 151, toggle 221, and tilt 235) exert continuous control over the angular position of the chair frame 3 on pivots 41 and it is not permitted to have a free rocking action such as found in a rocking chair. The maximum degree of tilt effected by the leg rest mechanism is determined by engagement of stop 193 on leg 185 (FIG. 9) with shoulder 195 on link 173 while the maximum degree of tilt effected by back frame recline is determined by movement of the carriage 37 to the end of the track 29. The non-tilt, upright position is determined by a stop means 281 with a stepped vertical flange that is secured to post 69 of the chair frame front cross brace structure 59 and a horizontal flange that overlies carriage front cross piece 33 and has a plastic pad 285 for abutting engagement with it to limit clockwise pivoting of the chair frame 3 relative to the carriage 5.

The tilt drive link 259 in conjunction with swing link extension 263 provide tilt means for both recline and leg rest tilting. Extension pivot 81 is to the chair frame 3 while bottom pivot 257 for the link 259 is, in effect, a pivot to the carriage 5. That could be done if the chair had no leg rest 13. Pivot 257 can only be moved by angular movement of the handle 15 and shaft 119 to activate tilt mechanism 235. Otherwise, it is fixed in accordance with the position of the leg rest 13 by virtue of stop 193, adjustable leg rest stop mechanism 201, or retract engagement of the leg rest 13 with the front of the chair frame. Thus, back recline in any position of the leg rest produces tilt since pivot pin 81 is pushed up and away from carriage 5 by clockwise turning of link 77. When the rocker link 249 is pivoted the tilt link 259 moves up or down to force corresponding movement of pivot 81 and chair frame 3.

As previously described, operation of the leg rest and associated tilting of the chair is energized by movement of the hand lever 15 with some assistance from toggle spring 231. Operation of the recline—translation—tilt system, however, is energized simply by weight shifting on the part of the chair occupant with no spring or lever assistance. When the chair occupant lets the weight of his or her back rest heavily against the back frame 11 most of it will be concentrated above the pivots 85 so that the links 83 plus the back frame 11 become long levers that translate this back pressure into forward motion of the draw bar 103 and carriage 5. As the back frame 11 pivots rearwardly the moment arm decreases but, to some extent, this is offset by tilting up of the front end of the chair frame 3 and seat 9 thereby increasing the component of the occupant's weight that is applied to the back frame. The freedom of this movement can be regulated by adjustment of the resistance devices 137. To reverse this motion and let the chair return to its upright position, the occupant of the chair simply leans forwardly to take his or her wieght off the back frame 11 and let that weight component be carried by the seat frame 9. This will let the links 83 swing back like pendulums toward their nearly vertical positions. This weight shifting is also assisted to some extent by decrease in tilt of the chair frame since this helps to shift weight forwardly away from the back frame 11. The weight balance provided by the pivots 41 and the tilting in conjunction with the chair swing support mechanism 75 enable the movements just described to be started and to continue without the need to push against the chair arms 53 or use other forms of leverage. Simple weight shifting on and off the back energizes the movements. As previously indicated, the weight distribution with respect to the pivots 41 also helps in operation of the leg rest mechanism.

Thus, the invention provides a reclinable chair with leg rest that is very confortable and easy to use. Modifications may be made in the details described without departing from the spirit and scope of the invention.

We claim:

1. A chair comprising base means, a chair frame, pivot means to tiltably mount said frame on said base means for pivotal tilting about a horizontal axis, a leg rest mounted on the chair frame for movement between a retracted position and an elevated position as well as intermediate positions, manually operated actuating means on the chair frame for moving the leg rest to said positions, tilt means acting between the chair frame and the base means for tilting the chair frame by pivoting it about said axis, and means operatively connecting the actuating means to the tilt means for simultaneously operating the tilt means to pivot the chair frame about said axis during movement of the leg rest and for holding the chair frame in a tilted position determined by and corresponding to the position of the leg rest.

2. A chair as set forth in claim 1 wherein said actuating means includes a hand operated lever for operation by a person seated in the chair in order to move said leg rest.

3. A chair comprising a chair frame, first means supporting said chair frame for longitudinal translation parallel to a floor and for tilting between forward and rear positions, a back frame, second means supporting said back frame on said chair frame for movement between upright and full recline positions in response to pressure applied by the back of an occupant of the chair, and third means interconnecting the chair frame and the back frame and the first and second means whereby movement of said back frame and tilting of said chair from occur together, said first means including a carriage mounted on a base and tiltably supporting the chair frame for pivoting about a fixed horizontal axis on the carriage and for longitudinal translation between rear-upright and forward-recline positions, said third means being interconnected to said carriage and base whereby longitudinal translation of the chair frame occurs together with tilting of the chair frame about said axis and movement of the back frame.

4. A reclining chair comprising base means, a chair frame, first means including a carriage supporting said chair frame on said base means for longitudinal translation between rear and forward positions, second means supporting said chair frame and on said carriage for tilting about a horizontal axis between forward and rear positions, a leg rest, third means supporting said leg rest on the chair frame for movement between retracted and elevated positions, a back frame, fourth means supporting said back frame on said chair frame for movement between upright and full recline positions, fifth means interconnecting the first, second and fourth means and responsive to back pressure on the back frame whereby movement of the back frame automatically translates said carriage and chair frame and tilts said chair frame on said carriage about said axis in amounts corresponding to and determined by the amount of movement of the back frame and holds the chair frame in its tilted position, sixth means for moving said leg rest on said third means, and seventh means interconnecting the second, third and sixth means responsive to movement of the leg rest whereby movement of the leg rest automatically tilts said chair frame on said carriage about said axis in an amount corresponding to and determined by the amount of movement of the leg rest and holds the chair frame in its tilted position.

5. A reclining chair comprising a base, a carriage mounted on the base for longitudinal horizontal movement toward the front and toward the rear of the chair, a chair frame mounted on the carriage and conjointly moving horizontally with it, a back frame mounted on the chair frame for movement between an upright position and a recline position through intermediate position in response to pressure from the back of an occupant of the chair, and linkage means actuated by movement of the back frame interconnecting the back frame, chair frame, carriage, and base for automatically moving and horizontally positioning the carriage on the base in accordance with the position of the back frame.

6. A chair as set forth in claim 5 wherein said chair frame is tiltably mounted on said carriage for pivoting about a horizontal axis fixed relative to the carriage and said linkage means includes tilt means that tilts said chair frame in accordance with the position of the back frame.

7. A chair as set forth in claim 6 including a leg rest mounted on said chair frame for movement between a retract position and an elevated position, handle actuated mechanism for operating the leg rest, said mechanism being interconnected with said linkage means so that operation of the leg rest tilts said chair frame in accordance with the position of the leg rest.

8. A chair as set forth in claim 5 wherein said chair frame is tiltably mounted on said carriage and said linkage means includes tilt means connected to said chair frame for tilting it on said carriage, a leg rest mounted on said chair frame for movement between a retract position and an elevated position, handle actuated mechanism for operating the leg rest, said mechanism being interconnected with said tilt means so that operation of the leg rest tilts said chair frame in accordance with the position of the leg rest.

9. A chair as set forth in claim 5 wherein said linkage means includes a long swing link on opposite sides of the chair frame having a top end adjacent the chair frame and a bottom end adjacent said carriage, pivot means between the top ends of the long swing links and the chair frame, said back frame being attached to each swing link so that recline pressure thereon by the back of a chair occupant is applied above the pivot means and moves the link in a forward direction about the pivot means, said linkage means including push link mechanism attached to and moved by the bottom ends of said links and connected to said base for moving the carriage on the base.

10. A chair as set forth in claim 9 including a seat frame, means securing the rear of the seat frame to intermediate points on said swing links whereby the seat frame is supported on and moves with the swing links, said linkage means including front links secured to the front of said seat frame and to said chair frame for movably supporting the front of said seat frame on said chair frame, said chair frame being tiltably mounted on said carriage, said linkage means including tilt drive links for tilting said chair frame on said carriage in accordance with the position of said back frame.

11. A chair as set forth in claim 10 including stop means on the chair frame and engageable with the carriage to limit tilting upon return of the back frame to an upright position.

12. A chair as set forth in claim 11 including adjustable resistance means connected to said linkage for selective control of resistance to movement of said back frame and long swing links.

13. A chair as set forth in claim 10 including pivot means between the chair frame and carriage to provide a horizontal axis about which the chair frame tilts, said axis being located on a level adjacent the bottom ends of said long swing links and a substantial distance forwardly of the pivot means at the top ends of the long swing links whereby a major part of the weight of a chair occupant is located to the rear of said horizontal axis and upon removal of pressure of the back of a chair occupant from the back frame provides the required force to move the long swing links in a rearward direction about their pivot means.

14. A chair as set forth in claim 13 wherein said tilt links are connected to said front links and to said carriage.

15. A chair as set forth in claim 10 wherein said front links are pivoted at their top ends to said seat frame and at intermediate points to said chair frame, said tilt drive links being pivoted at their top ends to the bottom ends of the front links, the bottom ends of the tilt drive links being pivoted on said carriage.

16. A chair as set forth in claim 15 including a leg rest mounted on said chair frame for movement between a retract position and an elevated position, handle actuated mechanism for operating the leg rest, said mechanism being interconnected with said tilt drive links so that operation of the leg rest tilts said chair frame in accordance with the position of the leg rest.

17. A chair as set forth in claim 15 wherein said mechanism includes rocker links pivoted intermediate their lengths on said carriage, the bottom ends of the tilt drive links being pivoted to the bottom ends of the rocker links, said mechanism including linkage connected to the top ends of said rocker links for pivoting the rocker links upon operation of the handle actuated mechanism.

18. A chair as set forth in claim 17 wherein said handle actuated mechanism includes a drive shaft rotatably supported on said chair frame, a handle mounted on said shaft for turning it, said mechanism linkage comprising drive links keyed to said shaft to turn with it, and connecting links pivoted at one end to a drive link and at the other end to the top end of a rocker link to provide means whereby said handle pivots said rocker link.

19. A chair as set forth in claim 18 including leg rest hold means for releasably holding said shaft against turning and said leg rest in a selected one of several positions.

20. A chair as set forth in claim 19 including toggle mechanism connected to said shaft and having spring means operative when the toggle goes over center to assist in turning the shaft to elevate the leg rest.

21. A chair as set forth in claim 9 wherein said push link mechanism includes rocker links on opposite sides of the chair, transversely extending means journalling intermediate points on said rocker links on said chair frame, push linkage pivotally connecting the rear ends of the rocker links to the bottom ends of the swing links whereby movement thereof rocks said rocker links on said transverse journal means, and long push links pivoted at their front ends to the front ends of the rocker links and at their rear ends to the rear of the base and serving to define the minimum distance between said transverse journal means and the rear of the base whereby movement of said swing links in a forward direction produces movement of said chair frame and carriage in a forward direction.

22. A reclining chair comprising a base, a carriage mounted on the base for longitudinal horizontal movement toward the front and toward the rear of the chair, a chair frame mounted on the carriage and movable horizontally with it, a back frame mounted on the chair frame for movement between an upright position and a recline position in response to pressure from the back of an occupant of the chair, and linkage means actuated by movement of the back frame interconnecting the back frame, chair frame, carriage, and base for automatically moving and horizontally positioning the carriage on the base in accordance with the position of the back frame, said linkage means including a long swing link on opposite sides of the chair frame having a top end adjacent the chair frame and a bottom end adjacent said carriage, pivot means between the top ends of the long swing links and the chair frame, said back frame being attached to each swing link so that recline pressure thereon by the back of a chair occupant is applied above the pivot means and moves the link in a forward direction about the pivot means, said linkage means including push link mechanism attached to and moved by the bottom ends of said links and connected to said base for moving the carriage on the base, push link mechanism including rocker links on opposite sides of the chair, transversely extending means journalling intermediate points on said rocker links on said chair frame, push linkage pivotally connecting the rear ends of the rocker links to the bottom ends of the swing links whereby movement thereof rocks said rocker links on said transverse journal means, and long push links pivoted at their front ends to the front ends of the rocker links and at their rear ends to the rear of the base and serving to define the minimum distance between said transverse journal means and the rear of the base whereby movement of said swing links in a forward direction, said transverse journal means including a transverse drive shaft extending between and journalled on opposite sides of the chair frame, a handle for turning the drive shaft, a leg rest supported on the chair frame for movement between retracted and elevated positions, and leg rest operating mechanism actuated by said transverse drive shaft and connected to said leg rest to move it between said retract and elevated positions.

23. A chair as set forth in claim 22 wherein said push linkage includes a transverse draw bar attached to the bottom ends of said swing links and link means connecting the draw bar to the rear ends of the rocker links.

24. A chair as set forth in claim 23 wherein said link means comprises brackets attached to the draw bar and having downwardly extending legs and upwardly slanted substantially straight links pivoted at their rear ends to said legs and at their forward ends to said rocker links, said rocker links and said long push links being substantially straight, said push link mechanism being arranged so that when said rocker links are pivoted to substantially vertical positions said long push links are substantially horizontal and parallel to and located between longitudinal sides of the base.

25. A reclining chair comprising a base, a carriage mounted on the base for longitudinal horizontal movement toward the front and toward the rear of the chair, a chair frame mounted on the carriage and movable horizontally with it, a back frame mounted on the chair frame for movement between an upright position and a recline position in response to pressure from the back of an occupant of the chair, and linkage means actuated by movement of the back frame interconnecting the back frame, chair frame, carriage, and base for automatically moving and horizontally positioning the carriage on the base in accordance with the position of the back frame, pivots mounting the chair frame on the carriage for tilting about a horizontal axis located at an intermediate point in the length of the chair frame, said linkage means including horizontal frame tilt pivots on the front of the chair frame whereby vertical movement of said frame tilt pivots tilts the chair frame about said horizontal axis, tilt links pivoted on said frame tilt pivots and extending downwardly, horizontal carriage tilt pivots mounted on said carriage, tilt drive links pivoted at their lower ends to said carriage tilt pivots and at their upper ends to the lower ends of the tilt links, and tilt actuating means for pivoting said links to change the distance between the axis of said frame tilt pivots and said carriage tilt pivots and thereby tilt the chair frame about said horizontal axis.

26. A chair as set forth in claim 25 wherein said tilt actuating means is a part of said linkage means whereby horizontal positioning of the carriage on the base produces tilting of the chair frame in accordance with the position of the back frame.

27. A chair as set forth in claim 25 including elevatable leg rest means mounted on said chair frame, said tilt actuating means being operably connected to said leg rest means whereby elevation of the leg rest means produces tilting of the chair frame in accordance with the position of said leg rest means.

28. A chair as set forth in claim 27 wherein said tilt actuating mechanism is a part of said linkage means whereby horizontal positioning of the carriage on the base produces tilting of the chair frame in accordance with the position of the back frame.

29. In a chair having a base, a chair frame, support means mounting the chair frame on the base for tilting about a horizontal axis located between the front end and the back end of the chair frame, elevatable leg rest means mounted on the chair frame including a leg rest frame movable between elevated and retracted positions, leg rest actuating means on the frame for actuating the leg rest means, a non-circular transverse shaft parallel to said horizontal axis journalled at opposite ends on said chair frame for operating said actuating means, a handle for manually turning the shaft to actuate the leg rest means, toggle means for affecting operation of the leg actuating means and including a toggle lever having a non-circular opening receiving the shaft whereby the lever and shaft turn together but the lever is shiftable along the length of the shaft, tilt means between the chair frame and support means for tilting the chair frame about said horizontal axis, tilt actuating means operatively connected to said tilt means and including a tilt lever having a non-circular opening receiving the shaft whereby the tilt lever and shaft turn together but the tilt lever is shiftable along the length of the shaft, and key means keying the toggle lever and tilt lever to each other for joint angular and longitudinal movement with respect to said shaft.

30. A chair as set forth in claim 29 wherein said levers have web portions perpendicular to said shaft and containing said non-circular openings, each lever having a flange extending at a right angle to its web and in the direction of the other lever, the flange of each lever being connected to the web of the other.

31. A chair as set forth in claim 30 wherein the web of one lever has a keyhole opening therein and the other lever has a key projection on the end of its flange projecting through and interlocked with the edge of the keyhole, the one lever having a right angle notch in the end of its flange and the web of the other lever fitting in said notch.

* * * * *